US005707275A

United States Patent [19]

Preis et al.

[11] Patent Number: 5,707,275

[45] Date of Patent: Jan. 13, 1998

[54] CLAMPING DEVICE FOR CLAMPING A TOOL

[75] Inventors: Erich Preis, Weinstadt; Siegfried Stämmele, Leutenbach; Alfred Schmidt, Waiblingen; Herbert Piater, Murrhardt, all of Germany

[73] Assignee: Atlas Copco Elektrowerkzeuge GmbH, Winnenden, Germany

[21] Appl. No.: 594,472

[22] Filed: Jan. 31, 1996

[30] Foreign Application Priority Data

Mar. 14, 1995 [DE] Germany ..... 195 09 147.7

[51] Int. Cl.[6] ..... B24B 41/00

[52] U.S. Cl. ..... 451/342; 451/509; 451/514

[58] Field of Search ..... 451/342, 398, 451/509, 514, 516, 508

[56] References Cited

U.S. PATENT DOCUMENTS

| | | | |
|---|---|---|---|
| 4,980,994 | 1/1991 | Helm et al. | 451/342 |
| 5,022,188 | 6/1991 | Borst | 451/342 |
| 5,042,207 | 8/1991 | Kirn | 451/342 |
| 5,177,905 | 1/1993 | Takahashi et al. | 451/342 |
| 5,545,078 | 8/1996 | Schulz et al. | 451/342 |

FOREIGN PATENT DOCUMENTS

| | | |
|---|---|---|
| 30 12 836 | 10/1981 | Germany . |
| 38 41 181 C2 | 11/1990 | Germany . |
| 39 17 345 | 11/1990 | Germany . |

*Primary Examiner*—James G. Smith
*Assistant Examiner*—Derris H. Banks
*Attorney, Agent, or Firm*—McGlew And Tuttle

[57] ABSTRACT

In a clamping device for clamping a disk-shaped tool to a threaded spindle of a hand-held machine tool, a nut part, which can be screwed onto the threaded spindle, presses a face plate against the tool. An axial rolling bearing is arranged between the nut part and the face plate. To achieve simple and reliable manual clamping and release, in conjunction with a slip clutch function under overload, a spring is arranged between the face plate and the nut part next to the axial rolling bearing. The spring forms a non-rotatable frictionally engaged connection between the nut part and the face plate. The axial rolling bearing supports the face plate on the nut part. The nut part slips in relation to the face plate when an upper limit value of the torque transmitted is exceeded, and the axial rolling bearing rotates.

13 Claims, 1 Drawing Sheet

CLAMPING DEVICE FOR CLAMPING A TOOL

FIELD OF THE INVENTION

The present invention pertains to a clamping device for clamping a disk-shaped tool, especially a grinding wheel, on a threaded spindle of a hand-held machine tool, wherein a nut part, which can be screwed onto the threaded spindle, presses a face plate against the tool and an axial rolling bearing is arranged between the nut part and the face plate.

For example, a grinding wheel is to be fastened to a right angle grinder with such a clamping device. The clamping device is an independent part, so that right angle grinders with usual threaded spindles can also be retrofitted with the clamping device.

BACKGROUND OF THE INVENTION

Such a clamping device is described in DE-OS 21 56 770. The friction between the tool or the face plate which is in contact with it and the nut part is to be essentially eliminated by the axial rolling bearing. As a result, the nut is not tightened farther during the operation. Consequently, the nut must be sufficiently tightened by means of a chuck key before the beginning of the operation in order to transmit the torque from the threaded spindle to the grinding wheel. A chuck key is needed for this in practice. The entire torque is transmitted in this design via a flange of the threaded spindle to the grinding wheel. The face plate itself does not transmit any torque to the grinding wheel.

DE 37 05 638 C1 discloses a clamping device in which the face plate with the nut part is wedged by clamping parts for transmitting the torque. To release the clamping device, the clamping parts are radially released by actuating a turntable ring. The nut part is correspondingly tightened under extreme load. The clamping device according to DE 37 05 638 C1 has no slip clutch function. The overall height of this clamping device is relatively great, which is inconvenient during work. Since the turntable ring is located close to the grinding wheel, actuation is rather inconvenient in practice.

A similar, quick-action clamping device is described in DE 40 31 725 A1. Spherical rolling bodies between the nut part, the face plate and the turntable ring run on specially designed tracks. There is no slip clutch function here, either.

A ring made of a sliding material is arranged between the nut part and the face plate in the clamping device according to WO 92/04 549 A1. The nut is tightened under extreme load so tightly that it can be released by hand only with difficulty. A pivotable flap is provided on the nut for actuating same.

A quick-action clamping device with a disk spring is described in DE 42 43 328 C1. The disk spring is to prevent the quick-action clamping device from becoming spontaneously detached from the threaded spindle during the deceleration of the grinding wheel. The disk spring is inactive during the operation with the grinding wheel; it does not lead to the overload slip clutch effect.

SUMMARY AND OBJECTS OF THE INVENTION

The object of the present invention is to suggest a clamping device of the type described in the introduction, which permits simple and reliable manual clamping and release, in conjunction with a slip clutch function during overload.

The above object is accomplished according to the present invention in a clamping device of the type described in the introduction by arranging a spring between the face plate and the nut part next to the axial rolling bearing, wherein the spring forms a frictionally engaged connection between the nut part and the face plate to transmit the torque from the threaded spindle to the tool, and the axial rolling bearing axially supports the face plate at the nut part, and the nut part slips through in relation to the face plate when an upper limit value of the torque is exceeded (overload), and the axial rolling bearing rotates.

When the nut part is tightened on the threaded spindle, the spring presses the face plate, so that the latter is pressed against the tool. Thus, there is a frictionally engaged connection to transmit the torque from the nut part to the face plate or the tool. At the beginning of the operation, the connection tightens until a torque value predetermined by the pretension of the spring disk is reached. The axial rolling bearing axially supports the face plate on the nut part.

The face plate slips in relation to the nut part in the case of overload, i.e., when the limit value of the torque is exceeded, e.g., during tilting of the grinding wheel. The slip clutch function is achieved as a result, by which a gear mechanism of the machine tool is protected from overload.

The nut part is actuated to release the clamping device. Manual clamping and release of the clamping device is possible without any auxiliary tool. To facilitate handling, a pivotable flap may be mounted on the nut part in a preferred embodiment of the present invention. This flap ensures easy screwing of the nut part.

Another advantage of the clamping device is that all right angle grinders having usual standard threaded spindles can be easily retrofitted. It is also favorable that the clamping device can be made in a flat design.

Other additional embodiments of the present invention arise from the following description of an exemplary embodiment.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 4:
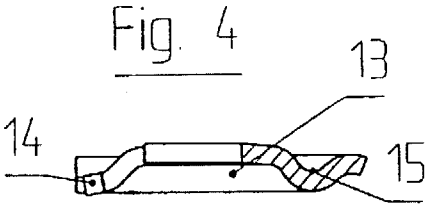
FIG. 4 is a sectional side view of the flap.
Figure 3:
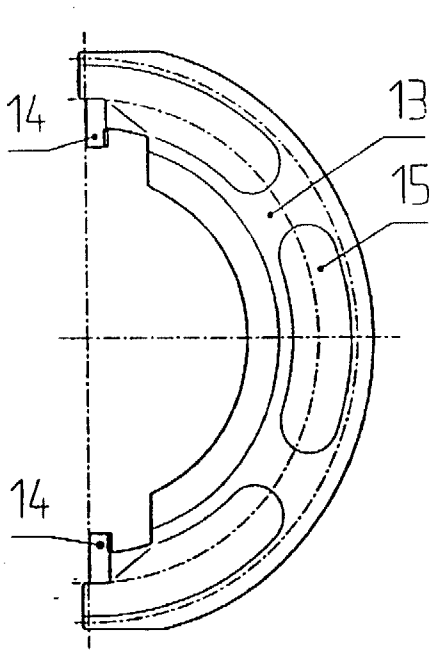
FIG. 3 is a top view of a flap for actuating the nut part.
Figure 2:
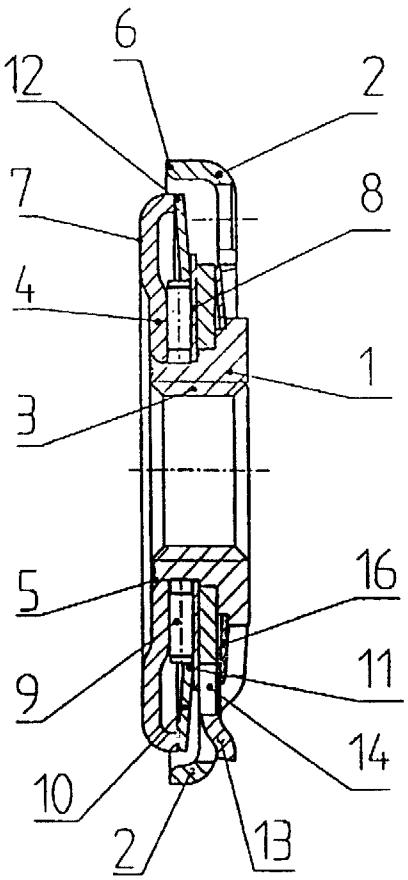
FIG. 2 is a sectional view along line II—II in FIG. 1.
Figure 1:
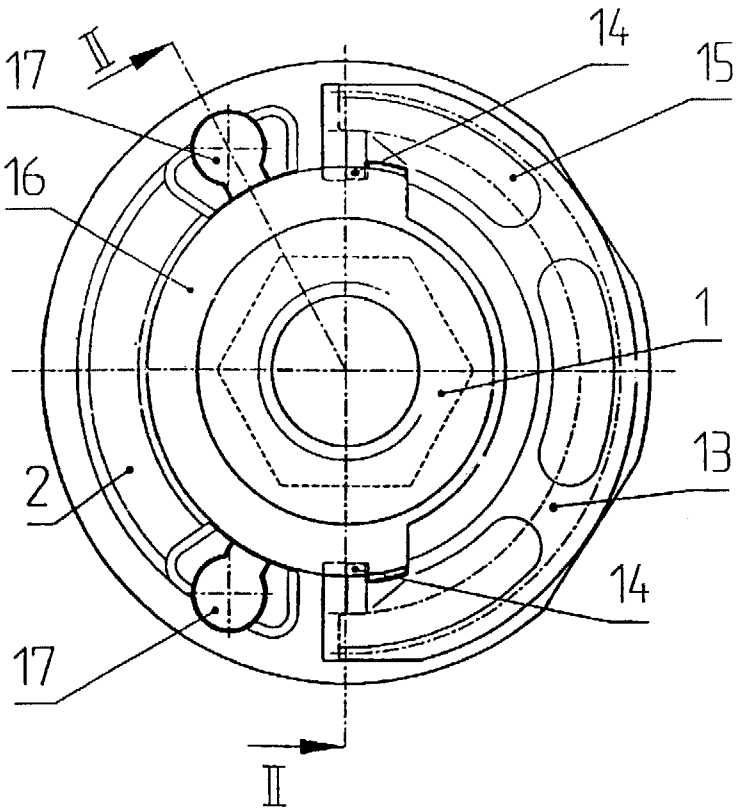
FIG. 1 is a top view of a clamping device for a face plate of a right angle grinder.

Referring to the drawings in particular, a clamping device is shown having a nut part, which comprises a nut 1 and a bell 2 arranged thereon non-rotatably in a positive-locking manner. The nut 1 can be screwed with an internal threaded section 3 onto a threaded spindle of a hand-held machine tool, e.g., a right angle grinder, not shown. The threaded spindle is provided with a flange, against which a grinding wheel, not shown specifically, can be pressed.

A face plate 4 is mounted rotatably on the nut 1 and axially displaceably by a small amount. A ring edge 5 of the nut 1 holds the face plate 4 at the nut 1. An outer edge 6 of the bell 2 is located in front of the outer circumference of the face plate 4.

An annular surface 7, which is used for coming into contact with the grinding wheel, is provided on the face plate 4. Consequently, the grinding wheel is located between the flange of the threaded spindle and the annular surface 7.

A hardened clamping washer 8 is located in the bell 2. An axial needle bearing 9, for which the clamping washer 8 acts as the running surface, is arranged between the bell 2 or the clamping washer 8 and the face plate 4. A ring-shaped disk spring 10, which is supported on the clamping washer 8 with its inner edge 11 and on the face plate 4 with its outer edge 12, is provided between the clamping washer 8 and the face plate 4. The disk spring 10 encloses the needle bearing 9 on its outer circumference. There are consequently two mechanically parallel transmission means between the nut part 1 and the face plate 4, namely, the axial needle bearing 9, on the one hand, and the disk spring 10, on the other hand. It would also be possible to provide another such spring, e.g., an undular washer, instead of the spring disk 10. It would also be possible to provide a rubber-elastic ring as the spring 10. The spring disk 10 or the ring seals the space in which the axial needle bearing 9 is located.

A flap 13 is pivotably mounted on the nut part 1, 2 by means of catches 14. The flap 13 extends over about 180° and is provided with depressions 15. The catches 14 are loaded by another disk spring 16 and are designed such that the flap 13 is locked in a position in which it lies flat on the bell 2 and in a position turned up by about 80°. The additional disk spring 16 is dimensioned such that the flap 13 moves automatically from the turned-up position into the position in which it lies on the bell 2 under the action of the centrifugal force when the threaded spindle, i.e., the nut part 1, 2, is rotating.

Auxiliary holes 17, with which the nut part 1, 2 can be released in special cases of disturbance by inserting a standard pin-type face spanner, are provided on the bell 2.

The mode of operation of the clamping device described is essentially as follows:

After the grinding wheel has been placed on the flange of the threaded spindle, the clamping device is attached to the threaded spindle, and the nut part 1, 2 is screwed up by means of the flap 13 with the flap 13 tilted up. The annular surface 7 of the face plate 4 now comes into contact with the grinding wheel and is pressed against the grinding wheel under tension caused by the disk spring 10.

Now, or at the time of working with the machine tool at the latest, a non-rotatable, frictionally engaged connection, brought about by the disk spring 10, is formed between the nut part 1, 2 and the face plate 4, and a non-rotatable, frictionally engaged connection is consequently also formed between the face plate 4 and the grinding wheel. The upper limit value of the torque that can be transmitted is limited by the tensioning force of the disk spring 10 and by the axial needle bearing 9 which prevents a further tightening of the disk spring 10. It is selected to be such that it is sufficient for the normal operation of the grinding wheel.

There is no relative movement in the needle bearing 9 during normal operation. It supports the face plate 4 on the bell 2 of the nut part 1, 2 via the clamping washer 8.

A relative movement takes place between the face plate 4 and the bell 2 in the case of overload on the grinding wheel, i.e., when the upper limit value of the torque is exceeded. Consequently, the disk spring 10 slips through with its inner edge 11 at the clamping washer 8 or the bell 2. The axial needle bearing 9 now rotates. It continues to support the face plate 4 on the nut part 1, 2. It is guaranteed due to this limitation of the transmissible torque, i.e., a slip clutch function, that the gear mechanism of the machine tool is protected from overload and even from lasting and shock-like overload, and that the nut part 1, 2 will not become tightened to the face plate 4 to the extent that manual release will later hardly be possible.

However, it would also be possible to provide a frictional connection or positive locking between the clamping washer 8 and the inner edge 11 of the disk spring 10, so that the disk spring 10 slips through with its outer edge 12 at the face plate 4 in the case of overload. This has the advantage that a larger portion of the axial forces is transmitted via the axial bearing 9. The torque needed to release the clamping device is reduced as a result.

To release the clamping device, the flap 13 is tilted up, and the nut part 1, 2 is loosened with it, while the disk spring 10 is released and the annular surface 7 of the face plate 4 separates from the grinding wheel as a result. In the normal case, the clamping device can be screwed off with ease without auxiliary means, because the torque limitation described prevents the face plate 4 from being tightened excessively against the nut part 1, 2 and the axial needle bearing 9 is provided. In addition, the disk spring 10 ensures that the face plate 4 loosens against the nut part 1, 2 before the face plate 4 separates from the grinding wheel. This is favorable, because the clamping device would otherwise be screwed off from the threaded spindle in the tensioned state.

The mode of operation described takes place in a flat section of the characteristic curve of the disk spring 10. The spring deflection is only a fraction of one μm, e.g., 2/10 μm. The disk spring 10 is pretensioned in the assembled state of the clamping device.

While a specific embodiment of the invention has been shown and described in detail to illustrate the application of the principles of the invention, it will be understood that the invention may be embodied otherwise without departing from such principles.

What is claimed is:

1. A clamping device for clamping a disk shaped tool on a threaded spindle of a hand-held machine tool, comprising:

a face plate for pressing against the tool;

a nut part which can be screwed onto the threaded spindle for pressing the face plate;

an axial rolling bearing arranged between said nut part and said face plate; and a spring arranged between said face plate and said nut plate adjacent to said axial rolling bearing, said spring defining a frictionally engaged connection between said nut part and said face plate to transmit torque from said threaded spindle to said tool, said axial rolling bearing axially supporting said face plate whereby said nut part slips through in relation to said face plate when an upper limit value of torque is exceeded, allowing said axial rolling bearing to rotate.

2. A clamping device according to claim 1, wherein said spring is a disk spring.

3. A clamping device according to claim 1, wherein said spring is pretensioned and a setting and release of said frictionally engaged connection takes place in a flat section of the characteristic curve of said spring.

4. A clamping device according to claim 2, wherein said spring is pretensioned and a setting and release of said frictionally engaged connection takes place in a flat section of the characteristic curve of said spring.

5. A clamping device according to claim 1, wherein said axial rolling bearing is a needle bearing.

6. A clamping device according to claim 2, wherein said disk spring encloses said axial rolling bearing in a radial plane.

7. A clamping device according to claim 1, further comprising a clamping washer which is in contact with said nut part, said spring disk being supported on said clamping washer.

8. A clamping device according to claim 1, wherein said nut part is formed of a nut and a bell non-rotatably arranged on said nut part.

9. A clamping device according to claim 8, wherein said bell surrounds said face plate on an outside.

10. A clamping device according to claim 1, further comprising a pivotable flap mounted on said nut part for actuating said nut part.

11. A clamping device according to claim 8, further comprising a pivotable flap connected to said bell for actuating said nut part.

12. A clamping device according to claim 10, wherein said flap is loaded in a locked position by means of said spring.

13. A clamping device according to claim 10, wherein said flap is designed and arranged such that said flap comes into contact with said nut part in a turned up position under action of centrifugal force of said nut part, during rotation.

* * * * *